US011026527B2

(12) United States Patent
Tsui

(10) Patent No.: US 11,026,527 B2
(45) Date of Patent: Jun. 8, 2021

(54) COLLAPSIBLE CUP

(71) Applicant: Sam Tung Tsui, Kowloon (HK)

(72) Inventor: Sam Tung Tsui, Kowloon (HK)

( * ) Notice: Subject to any disclaimer, the term of this patent is extended or adjusted under 35 U.S.C. 154(b) by 46 days.

(21) Appl. No.: 16/371,979

(22) Filed: Apr. 1, 2019

(65) Prior Publication Data

US 2020/0305619 A1 Oct. 1, 2020

(51) Int. Cl.

*A47G 19/22* (2006.01)
*B65D 1/02* (2006.01)
*B65D 21/08* (2006.01)

(52) U.S. Cl.

CPC ..... *A47G 19/22* (2013.01); *B65D 1/0292* (2013.01); *B65D 21/086* (2013.01); *A47G 2019/2277* (2013.01)

(58) Field of Classification Search

CPC ..... A47G 19/22; A47G 2019/2277; A47G 2021/002; B65D 21/086; B65D 1/0292; B65D 7/24; B65D 9/12; B65D 11/18; B65D 35/00; B65D 2501/24184; B65D 47/26; B65D 47/06; B65D 51/18; B65D 2251/0003

USPC ..... 220/703, 711, 713, 714, 666, 669, 907; 206/217, 218

See application file for complete search history.

(56) References Cited

U.S. PATENT DOCUMENTS

| | | | |
|---|---|---|---|
| 1,224,519 | A | 5/1917 | Brenner et al. |
| 1,260,779 | A | 3/1918 | Koos |
| 1,296,742 | A | 3/1919 | Bevington |
| 1,574,495 | A | 2/1926 | Look |
| 1,724,743 | A | 8/1929 | Allen |
| D110,613 | S | 7/1938 | Doughty |
| 2,899,110 | A | 8/1959 | Parker |
| 3,143,429 | A | 8/1964 | Swanson |
| 3,220,544 | A | 11/1965 | Lovell |
| 3,329,298 | A | 7/1967 | Perry |
| D210,307 | S | 2/1968 | Branscum |
| 3,471,058 | A | 10/1969 | Latham |

(Continued)

FOREIGN PATENT DOCUMENTS

| | | | |
|---|---|---|---|
| CN | 204527899 | U | 8/2015 |
| CN | 206880538 | U | 1/2018 |
| CN | 207477319 | U | 6/2018 |

OTHER PUBLICATIONS

Anthropologie; Stojo Collapsible Travel Cup; https://www.anthropologie.com/shop/stojo-collapsible-travel-cup?category=SEARCHRESULTS&color=003; pp. 1-4; Feb. 21, 2019.

(Continued)

*Primary Examiner* — Kareen K Thomas

(74) *Attorney, Agent, or Firm* — Hinshaw & Culbertson LLP

(57) ABSTRACT

A collapsible container, particularly a cup or mug having a flexible body having a top tier, middle tier and a bottom tier is disclosed. The bottom tier has a base. The container has a first living hinge between the top and middle tiers and a second living hinge between the middle and bottom tiers. A rigid, preferably metal, plate is at least partially embedded in the bottom tier that makes the otherwise flexible base rigid. The container can have a rigid metal cladding around the top tier and a handle made of flexible material. The collapsible container may be made by injection molding.

17 Claims, 11 Drawing Sheets

(56) References Cited

U.S. PATENT DOCUMENTS

| | | | | |
|---|---|---|---|---|
| 3,717,276 | A * | 2/1973 | Luczak | B65D 51/1611 215/255 |
| D236,170 | S | 7/1975 | Birrell | |
| D242,074 | S | 10/1976 | Kulp | |
| 4,428,507 | A | 1/1984 | Sneider | |
| 4,456,134 | A * | 6/1984 | Cooper | B65D 1/0292 215/12.1 |
| 4,492,313 | A | 1/1985 | Touzani | |
| RE32,379 | E | 3/1987 | Touzani | |
| 4,773,458 | A * | 9/1988 | Touzani | B65D 1/323 220/666 |
| D329,167 | S | 9/1992 | Robbins, III | |
| D329,168 | S | 9/1992 | Robbins, III | |
| D329,169 | S | 9/1992 | Robbins, III | |
| D335,744 | S | 5/1993 | Small | |
| 5,255,808 | A * | 10/1993 | Tobler | B65D 1/0292 206/218 |
| D344,657 | S | 3/1994 | Knopp | |
| 5,310,068 | A * | 5/1994 | Saghri | B65D 1/0292 215/12.1 |
| 5,384,138 | A * | 1/1995 | Robbins, III | B29C 53/08 426/111 |
| D356,713 | S | 3/1995 | Groover | |
| D360,100 | S | 7/1995 | Van Den Berghe | |
| D378,055 | S | 2/1997 | Waldon | |
| 5,632,406 | A * | 5/1997 | Robbins, III | B65D 25/325 220/666 |
| D386,933 | S | 12/1997 | Browne | |
| 5,900,293 | A | 5/1999 | Zettle | |
| 6,354,456 | B2 | 3/2002 | Rapson | |
| 6,705,471 | B2 | 3/2004 | Kataoka | |
| 6,736,285 | B2 | 5/2004 | Stewart-Stand | |
| D529,749 | S | 10/2006 | Allen | |
| D574,673 | S | 8/2008 | Tsui | |
| 7,654,402 | B2 | 2/2010 | Kusuma et al. | |
| 7,678,271 | B2 | 3/2010 | Curtin | |
| D615,826 | S | 5/2010 | Tsui | |
| 7,819,263 | B1 | 10/2010 | DiCarlo-Nelson | |
| D656,800 | S | 4/2012 | Lee et al. | |
| D658,949 | S | 5/2012 | Tsui | |
| 8,215,230 | B2 | 7/2012 | Curtin | |
| 8,215,509 | B2 * | 7/2012 | Kuboi | B65D 1/0292 215/381 |
| D668,148 | S | 10/2012 | Sory | |
| D692,715 | S | 11/2013 | Tsui | |
| D706,134 | S | 6/2014 | Sory | |
| D716,094 | S | 10/2014 | Wang | |
| 8,887,942 | B2 | 11/2014 | Miksovsky et al. | |
| D724,905 | S | 3/2015 | Tsui | |
| D731,225 | S | 6/2015 | Peterson | |
| 9,044,082 | B2 | 6/2015 | Kusuma et al. | |
| 9,119,507 | B2 * | 9/2015 | Abrams | A47J 41/0055 |
| D749,373 | S | 2/2016 | Tsui | |
| 9,296,508 | B2 * | 3/2016 | Kanfer | B05B 11/00414 |
| D777,520 | S | 1/2017 | Singlaub | |
| D779,886 | S | 2/2017 | Singlaub | |
| D802,852 | S | 11/2017 | Baker | |
| 9,969,521 | B2 | 5/2018 | Shen | |
| 10,124,942 | B2 * | 11/2018 | Seiders | B29C 45/0013 |
| 10,611,564 | B1 * | 4/2020 | Stravitz | B65F 1/0046 |
| 2005/0017015 | A1 * | 1/2005 | Higuchi | B65D 1/0292 220/666 |
| 2005/0127074 | A1 * | 6/2005 | Kusuma | B65D 21/086 220/6 |
| 2006/0096929 | A1 | 5/2006 | Repp et al. | |
| 2006/0201945 | A1 * | 9/2006 | Tedford, Jr. | B65D 47/286 220/254.9 |
| 2007/0023439 | A1 | 2/2007 | Vaughn | |
| 2007/0290466 | A1 | 12/2007 | Lenz | |
| 2009/0032153 | A1 | 2/2009 | Burnett | |
| 2009/0050429 | A1 | 2/2009 | Adams, Jr. | |
| 2010/0072166 | A1 | 3/2010 | Dickie | |
| 2011/0036806 | A1 | 2/2011 | Gregg et al. | |
| 2011/0248037 | A1 * | 10/2011 | Fung | B65D 81/3869 220/592.2 |
| 2011/0272419 | A1 | 11/2011 | Vanderberg et al. | |
| 2012/0205371 | A1 * | 8/2012 | Lee | B65D 47/286 220/8 |
| 2012/0217238 | A1 * | 8/2012 | Chang | B65D 21/08 220/8 |
| 2013/0032592 | A1 | 2/2013 | Lee | |
| 2013/0075393 | A1 | 3/2013 | Haynie | |
| 2013/0206800 | A1 | 8/2013 | Simonsen | |
| 2013/0264340 | A1 * | 10/2013 | Zens | B65B 1/02 220/8 |
| 2013/0277364 | A1 | 10/2013 | Kusuma et al. | |
| 2013/0284753 | A1 | 10/2013 | Kellmann | |
| 2015/0251795 | A1 | 9/2015 | Tsui | |
| 2015/0251808 | A1 | 9/2015 | Tsui | |
| 2015/0291309 | A1 | 10/2015 | McGregor | |
| 2016/0159518 | A1 * | 6/2016 | Hollis | A45F 3/20 220/7 |
| 2016/0347503 | A1 | 12/2016 | Tsui | |

OTHER PUBLICATIONS

Indiegogo; Stojo Biggie: Collapsible Leak-Proof Coffee Cup; Campaign Jun. 2, 2016; https://www.indiegogo.com/projects/stojo-biggie-collapsible-leak-proof-coffee-cup#/; pp. 1-18.

Kickstarter; by Ben Melinger; Smash Cup: A reusable coffee cup that fits in your pocket; Kickstarter campaign funding period Jul. 8, 2014 through Aug. 7, 2014; https://www.kickstarter.com/projects/melinger/smash-cup-a-reusable-coffee-cup-that-fits-in-your; 13 pages; Feb. 21, 2019.

Blog-News; Posted by Jurrien Swarts; Stojo: The Collapsible Pocket Cup; https://stojo.co/blogs/news; 6 pages; Feb. 21, 2019.

Normann Copenhagen, Strainer blue, Funnel & Strainer, 6 pages, visited Dec. 19, 2013 at https://www.normann-copenhagen.com/products/strainer.

* cited by examiner

COLLAPSIBLE CUP

FIELD OF THE INVENTION

The present invention relates to collapsible containers. More particularly, it relates to shape-retaining collapsible containers such as cups, mugs or glasses for holding potable liquids for consumption by a user.

BACKGROUND

People have been buying collapsible mugs for a variety of reasons. In some cases, the containers are collapsed and kept in a purse and expanded and used when the owner obtains a beverage such as at a coffee shop. In this way, the use and disposal of disposable containers is avoided. In other case, the containers are used by travelers including hikers and campers who need to pack the container into a small space. Collapsible mugs are also purchased by people living in small living spaces such as apartments.

It has been found that collapsible containers generally and mugs particularly can be difficult to make reliably when the containers and mugs have to be water tight.

Additionally some configurations of collapsible containers, particularly ones with five tiers, naturally have narrow bases which are problematic for mugs which already tend to be tall and narrow. Further narrowing the base makes it more likely that the collapsible mug will be knocked over.

It has also been found that some collapsible mugs have poor collapsibility.

It has also been found that some collapsible mugs are difficult to expand except by pushing the bottom out from the inside. This is generally non-hygienic.

Some collapsible mugs have a chunky appearance or are otherwise unsightly.

Collapsible mugs are by their collapsible nature made of flexible material that can fold when the mug is collapsed. However, this material typically offers little or no resistance to deformation caused by lateral forces, such as an object bumping into or pressing against the side of the container, or a user attempting to grasp or lift the container by the flexible wall section, which could result in the contents being spilled.

Previous designs for collapsible mugs have not had handles with openings for fingers to grip the handle. Some users prefer such a handle when the beverage in the mug is very hot or cold.

A need therefore exists for a collapsible mug that is easier to manufacture, does not have an overly narrow base, has good collapsibility, can be hygienically expanded easily, looks good, can be easily grasped without deforming the mug and has a handle with an opening for one or more fingers. Additionally, the mug needs to be self-supporting in at least a fully collapsed and a fully expanded state and water tight.

SUMMARY OF THE INVENTION

A collapsible container of a flexible material is provided. It has a flexible body including (1) a plurality of tiers including a top tier, a middle tier and a bottom tier and (2) a plurality of living hinges including a first living hinge between the top tier and the middle tier and a second living hinge between the middle tier and the bottom tier. The bottom tier has a base. The container also has a rigid plate at least partially embedded in the bottom tier that makes the otherwise flexible base rigid. Preferably the containers have a volume of 50-2000 ml, more preferably 100-1500 ml, and most preferably 200-1000 ml.

Preferably, the container has a collapsed state in which the bottom tier is at least partially located within the top tier. The container in the collapsed state may be expanded to an expanded state by gripping the exterior of the base and pulling the base away from the top tier. The container may also have a rigid cladding providing rigidity to the top tier so that the container may be easily gripped around the top tier.

Preferably, the container has a rigid cladding providing rigidity to the top tier so that the container may be easily gripped around the top tier. The top tier may have an elastomeric grip around the rigid cladding. The top tier may have a handle having an opening for one of more fingers. The handle may have an internal rigid ring and an elastomeric material covering the internal rigid ring and joining the handle to the flexible body, the handle being rigid and rigidly joined to the flexible body.

Preferably, the container has a rigid cladding providing rigidity to the top tier so that the container may be easily gripped around the top tier. The container may have a top opening and a removable lid having a selectively closable opening. The lid may have a circumferential sealing protuberance, which is in contact with the top tier when the lid is fully inserted into the top opening. The container may have a rim around the top opening. The rim is covered by the rigid cladding, which has an underside inside the container. The protuberance is in contact with the underside of the rigid cladding.

Preferably, the top tier is adjacent the middle tier and the bottom tier is adjacent the middle tier when the container is in the expanded state. Preferably, the middle tier is more flexible than the top and bottom tiers.

Preferably, the container has a sidewall extending below the top tier and the sidewall has a smooth appearance.

Preferably, the rigid plate improves the collapsibility of the container.

Preferably, the rigid plate has an outer portion embedded into the bottom tier and a central portion having a recess that is either above or below the outer portion. The flexible body fills the recess to maintain the rigid plate at least partially embedded in the bottom tier. The metal plate may be visible from below the container or through an opening in the top tier.

Preferably, the flexible body is unitary and watertight.

A method of manufacturing a collapsible container of flexible material is provided. The method includes placing a rigid plate inside a bottom portion of a mold and injecting a flexible material into the mold and around the rigid plate in the mold. The mold is configured to form the collapsible container. The collapsible container has a body of the flexible material, the body including (1) a plurality of tiers including a top tier, a middle tier and a bottom tier and (2) a plurality of living hinges including a first living hinge between the top tier and the middle tier and a second living hinge between the middle tier and the bottom tier. The bottom tier has a base. The bottom portion of the mold corresponds to the bottom tier of the collapsible container. The rigid plate makes the otherwise flexible base rigid.

Preferably, the method includes placing a rigid cladding preform in the mold. The injecting includes injecting the flexible material into contact with the rigid cladding preform to form the collapsible container with rigid cladding.

Preferably, the method includes placing a handle preform having a ring in the mold. The injecting includes injecting the flexible material into contact with the handle preform to form the container with a handle.

DETAILED DESCRIPTION OF THE INVENTION

Figure 1:
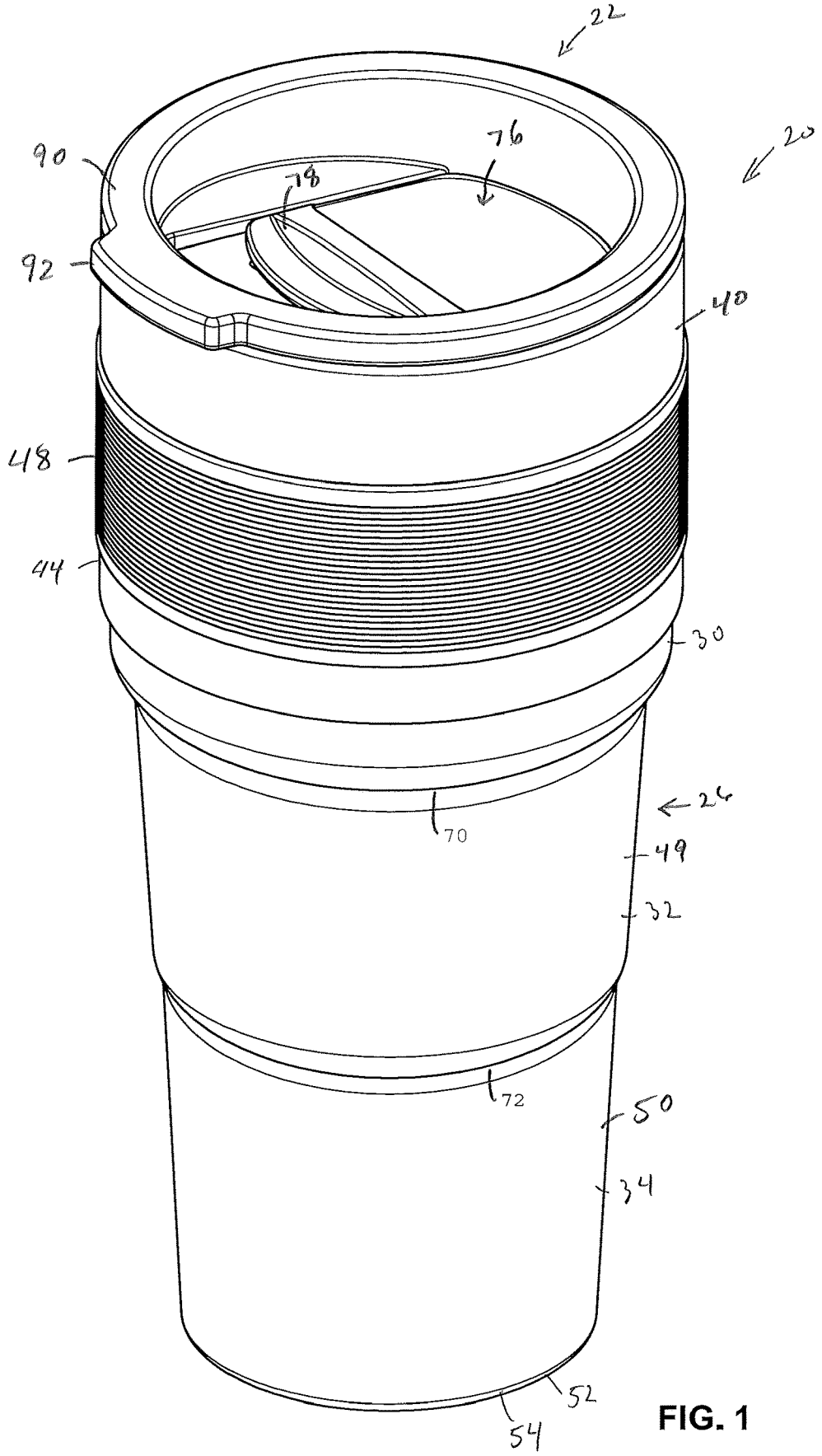
FIG. 1 is a perspective view of a collapsible mug according to one aspect of the invention, in a fully expanded state.
Figure 2:
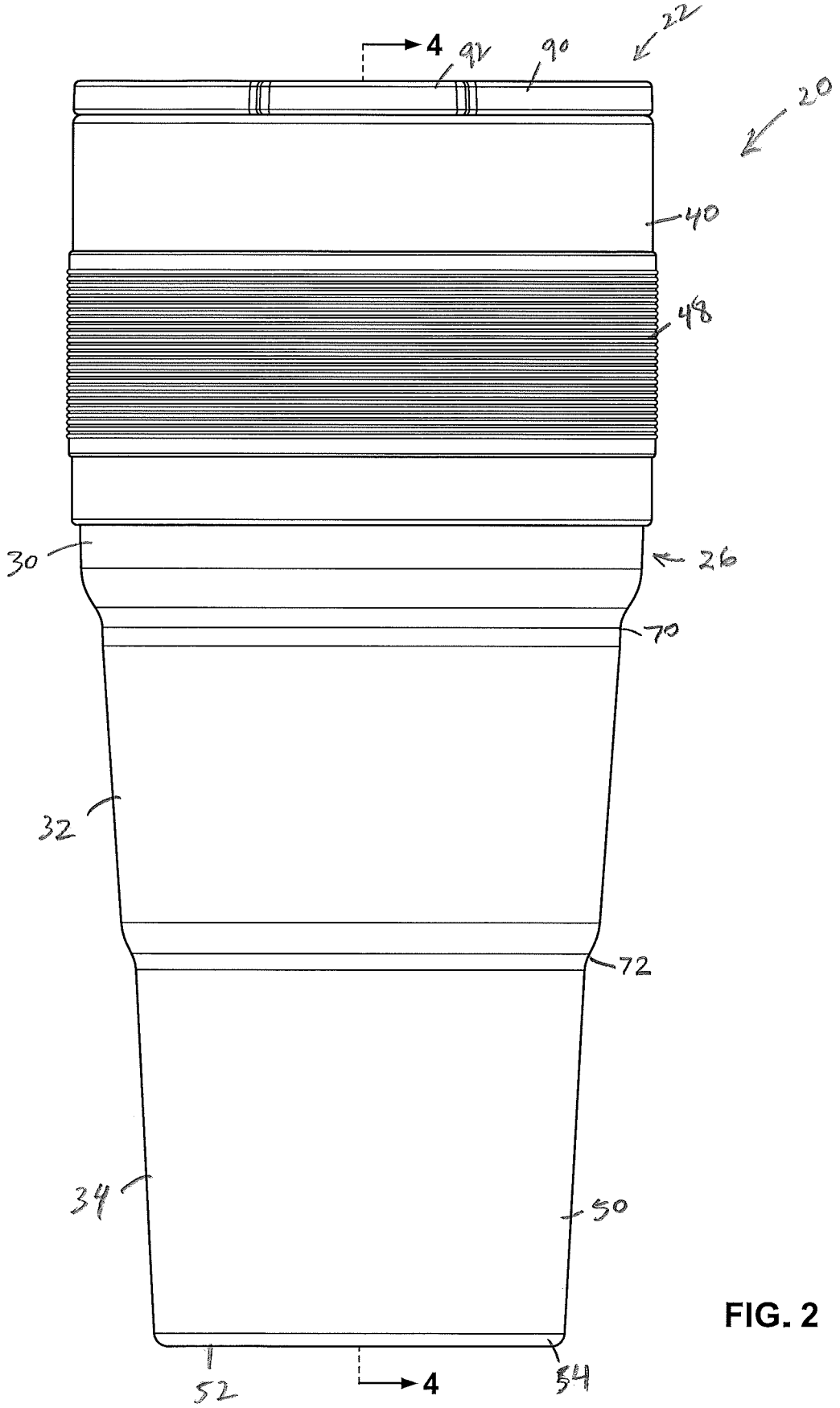
FIG. 2 is an elevation view of the mug in FIG. 1 in the fully expanded state.
Figure 3:
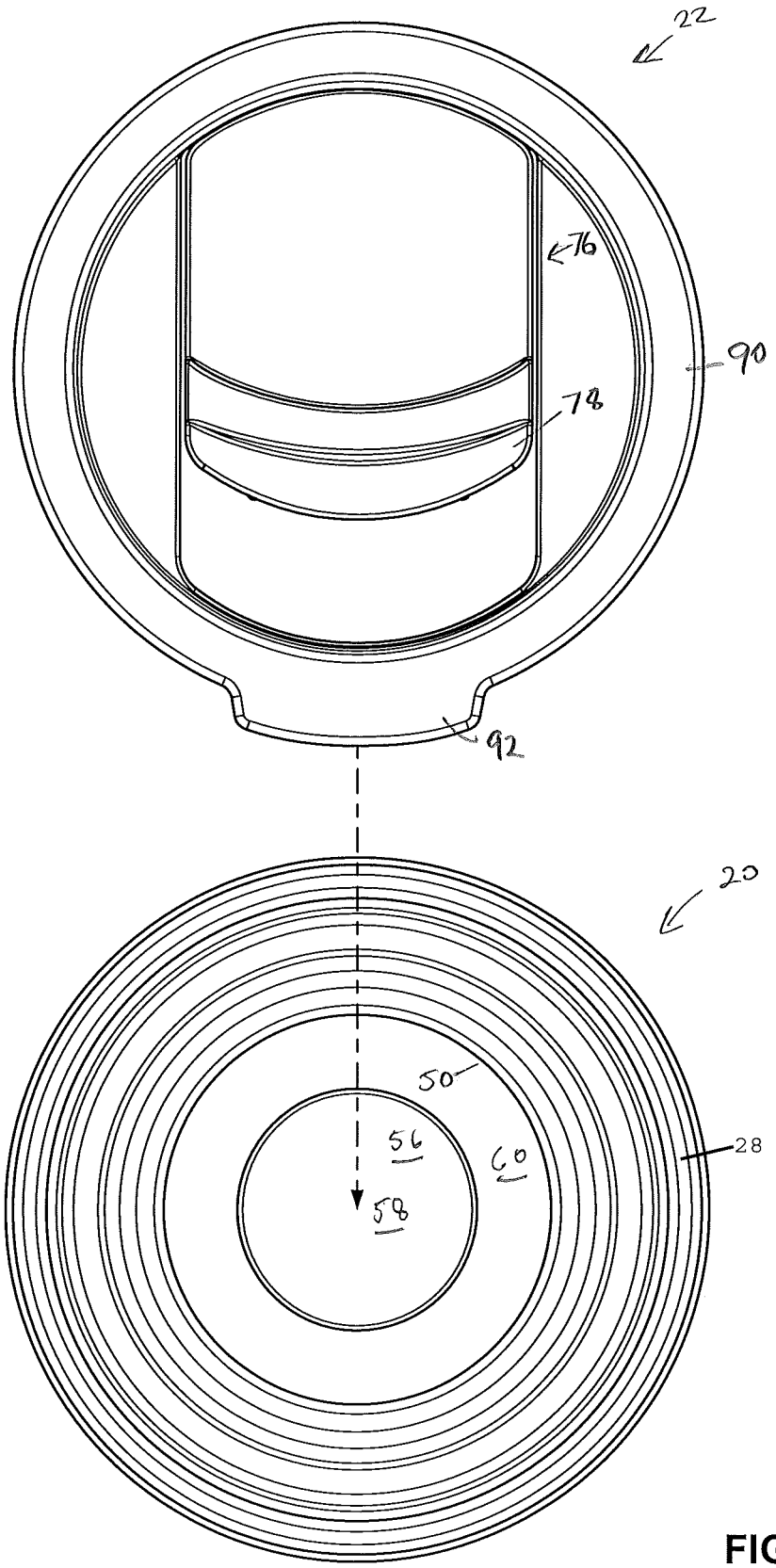
FIG. 3 is a partially exploded, plan view of the mug in FIG. 1 from above in the fully expanded state.

Collapsible containers in accordance with the present invention are described in this section, with reference to a mug 20 depicted in FIGS. 1-7 and a collapsible mug 120 having a handle depicted in FIGS. 8-13. The term mug as used herein refers to handheld containers having a narrow base relative to its top which are used for drinking. Therefore, the term mug refers to containers such as cups and glasses. Preferably the containers have a volume of 50-2000 ml, more preferably 100-1500 ml, and most preferably 200-1000 ml.

With reference to FIGS. 1-7, mug 20 according to one embodiment of the invention is described and illustrated. Mug 20 has a lid 22 and a flexible body 26, which is preferably unitary and preferably watertight, and made from a flexible material. Body 26 has an opening 28 which is covered by lid 22. Body 26 preferably has three tiers, top tier 30, a middle tier 32 and a bottom tier 34. Each tier is substantially cylindrical.

Mug 20 has a rim 36 and a metal cladding 40 which covers rim 36 and most of the outside of top tier 30. Metal cladding 40 also covers part of the inside of top tier 30. Metal cladding 40 has a hook 42 which is embedded into top tier 30 around a circumference 44 of top tier 30. Hook 42 can be completely bent back as in a fishing hook, but is sufficient that it angle into top tier 30 so that it is held by tier 30. Cladding 40 has a circumferential recessed portion 46. An elastomeric grip 48 resides in recessed portion 46. Elastomeric grip 48 is of sufficient height to make it easy to grip mug 20 even if the outside of top tier 30 is wet. Cladding 40 makes top tier 30 rigid.

Middle tier 32 is located between top tier 30 and bottom tier 34. Middle tier is preferably flexible relative to top tier 30 and bottom tier 34. It has a sidewall 49.

Bottom tier 34 has a sidewall portion 50 and a base portion 54 which is part of base 52 of mug 20. Sidewall portion 50 is stiff although made from a flexible material relative to sidewall 49, which is generally thinner than sidewall portion 50. Mug 20 has a metal plate 56, which is a generally circular or disc shaped with a raised central portion 58 and an annular flange portion 60. Portion 60 has an outer annulus 62 that is embedded into bottom tier 34 proximate to where sidewall portion 50 meets base portion 54. Base portion 54 has a raised central portion 66 which follows the underside of plate 56 to better maintain plate 56 in place and is also raised such that it would not contact a flat surface on which mug 20 is placed. As shown none of plate 56 is visible from a perspective beneath base portion 54. Bottom tier 34 can vary from the above description in several ways. Base 52 need not be entirely raised off the surface on which mug 20 is placed. Base portion 54 may not cover the entirety of the underside of plate 56 in which case plate 56 could have a circumferential hook (not shown) like hook 42. Plate 56 could not have raised central portion 58 in which case plate 56 could have the circumferential hook. Alternatively, instead of raised central portion 58, plate 56 could have a depressed central portion (not shown) and rather than base portion 54 being underneath plate 56, base portion is over plate 56 and follows the top side of plate 56 to better maintain plate 56 in place.

Flexible body 26 has a plurality of living hinges, preferably two, including a first living hinge 70 and a second living hinge 72. First living hinge 70 is located between top tier 30 and middle tier 32. Second living hinge 72 is located between middle tier 32 and bottom tier 34. Preferably, first and second living hinges 70, 72 connect the tiers that they are located between. Living hinges 70 and 72 are shown as being folded in FIGS. 5-7 which illustrate mug 20 in a fully collapsed state and unfolded in FIGS. 1-4 which illustrate mug 20 in a fully expanded state. It is also possible for one of living hinges 70 and 72 to be folded and the other to be unfolded in a partially collapsed state.

Figure 4:
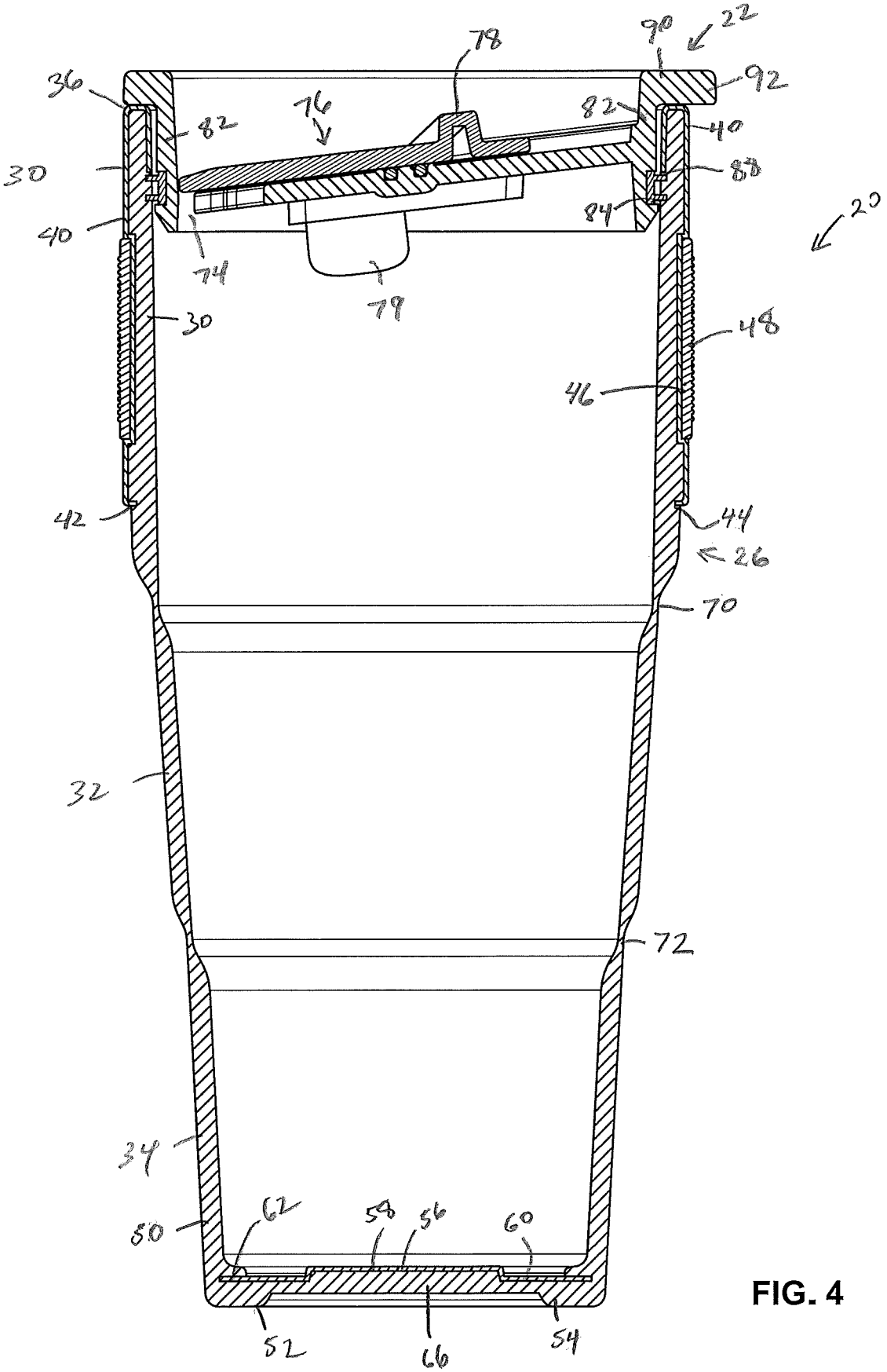
FIG. 4 is a cross-sectional elevation view of the mug of FIG. 1 in the fully expanded state along line 4-4 shown in FIG. 2.
Figure 5:
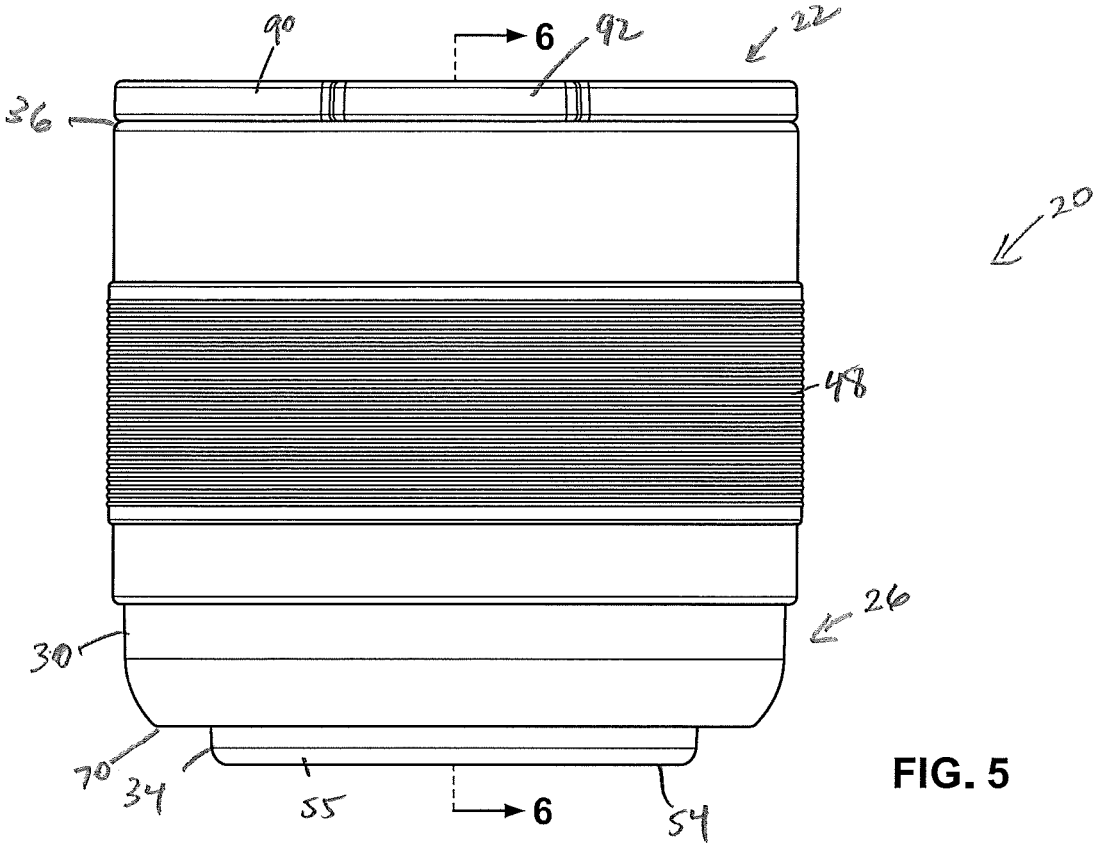
FIG. 5 is an elevation view of the mug of FIG. 1 in the fully collapsed state.
Figure 6:
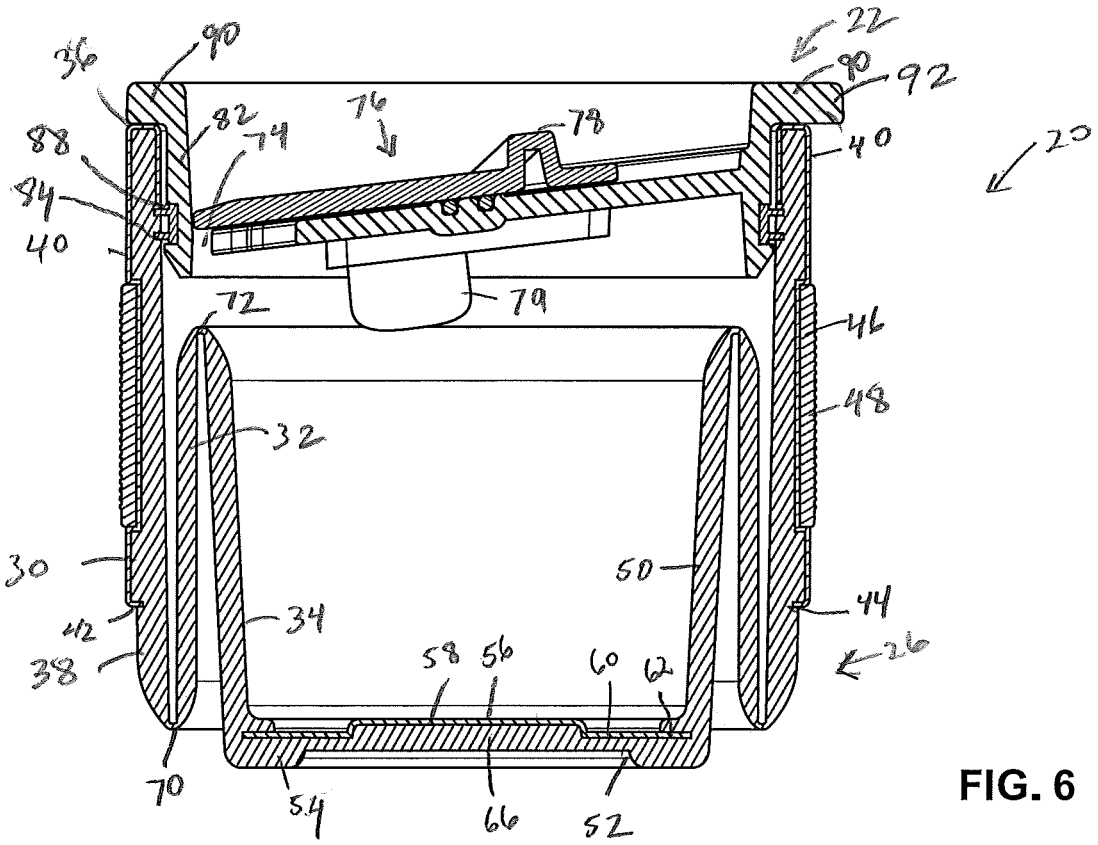
FIG. 6 is a cross-sectional elevation view of the mug of FIG. 1 in a fully collapsed state along line 6-6 shown in FIG. 5.
Figure 7:
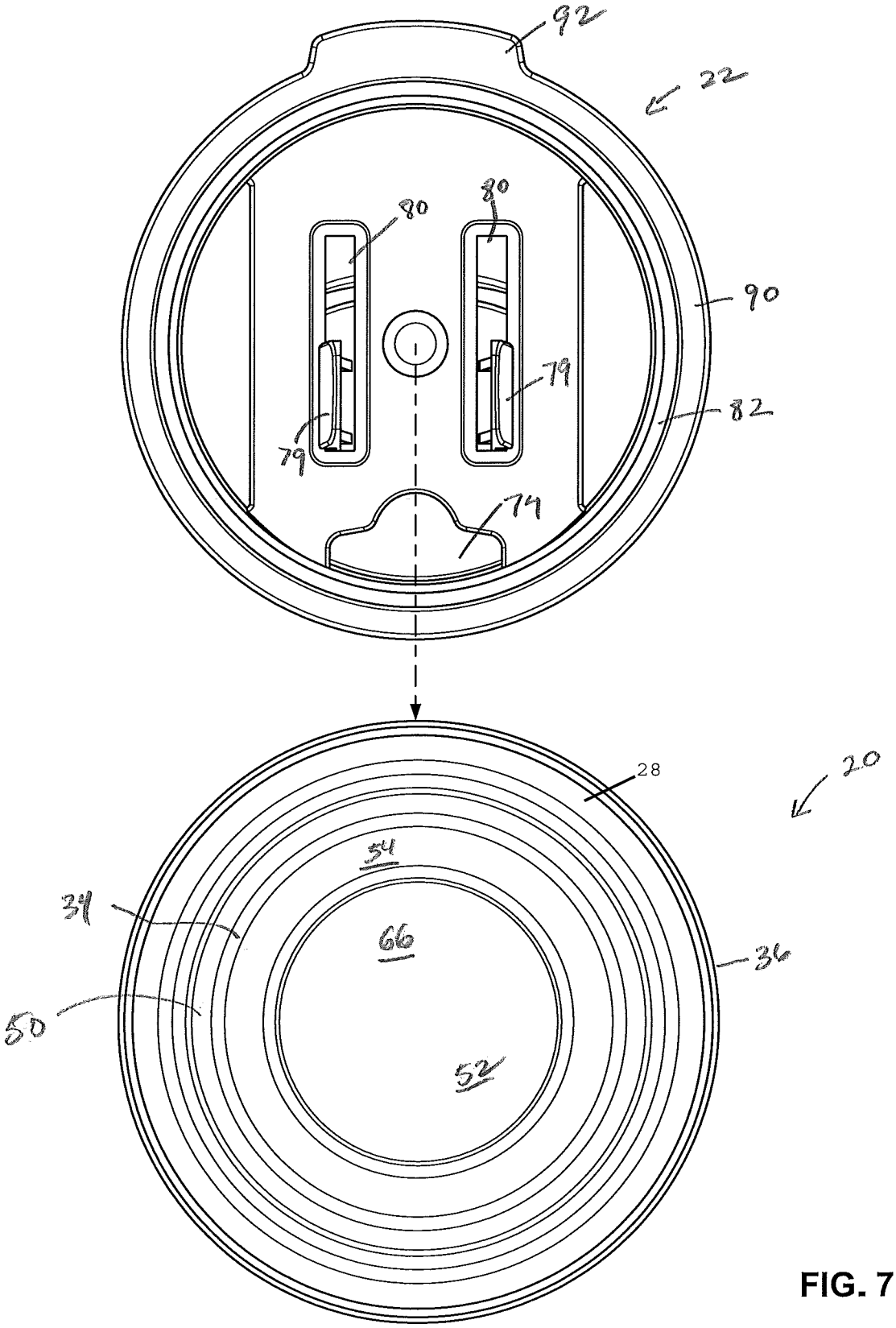
FIG. 7 is a partially exploded, plan view of the mug in FIG. 1 from below in the fully collapsed state.
Figure 8:
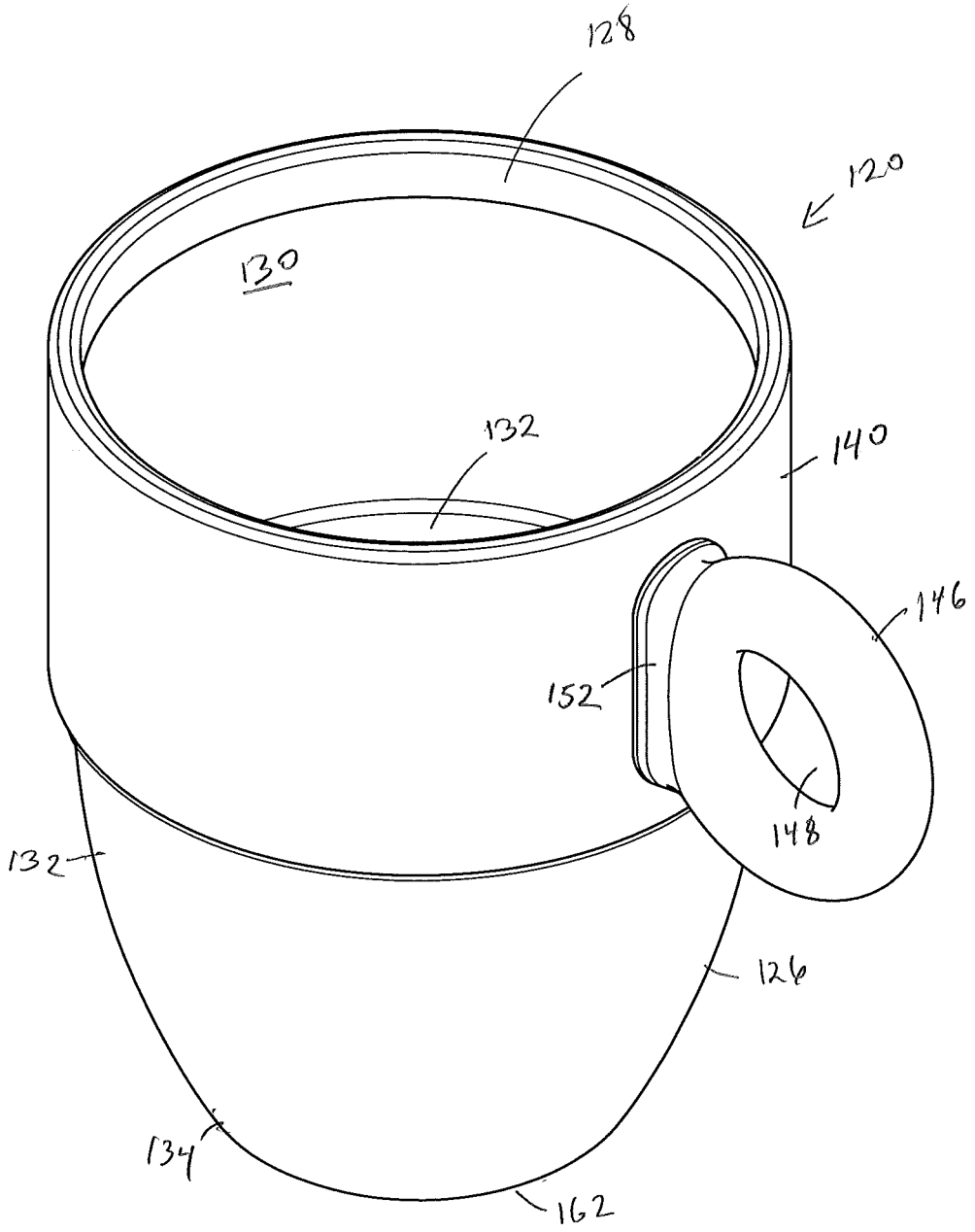
FIG. 8 is a perspective view of a collapsible mug according to another aspect of the invention, in a fully expanded state.
Figure 9:
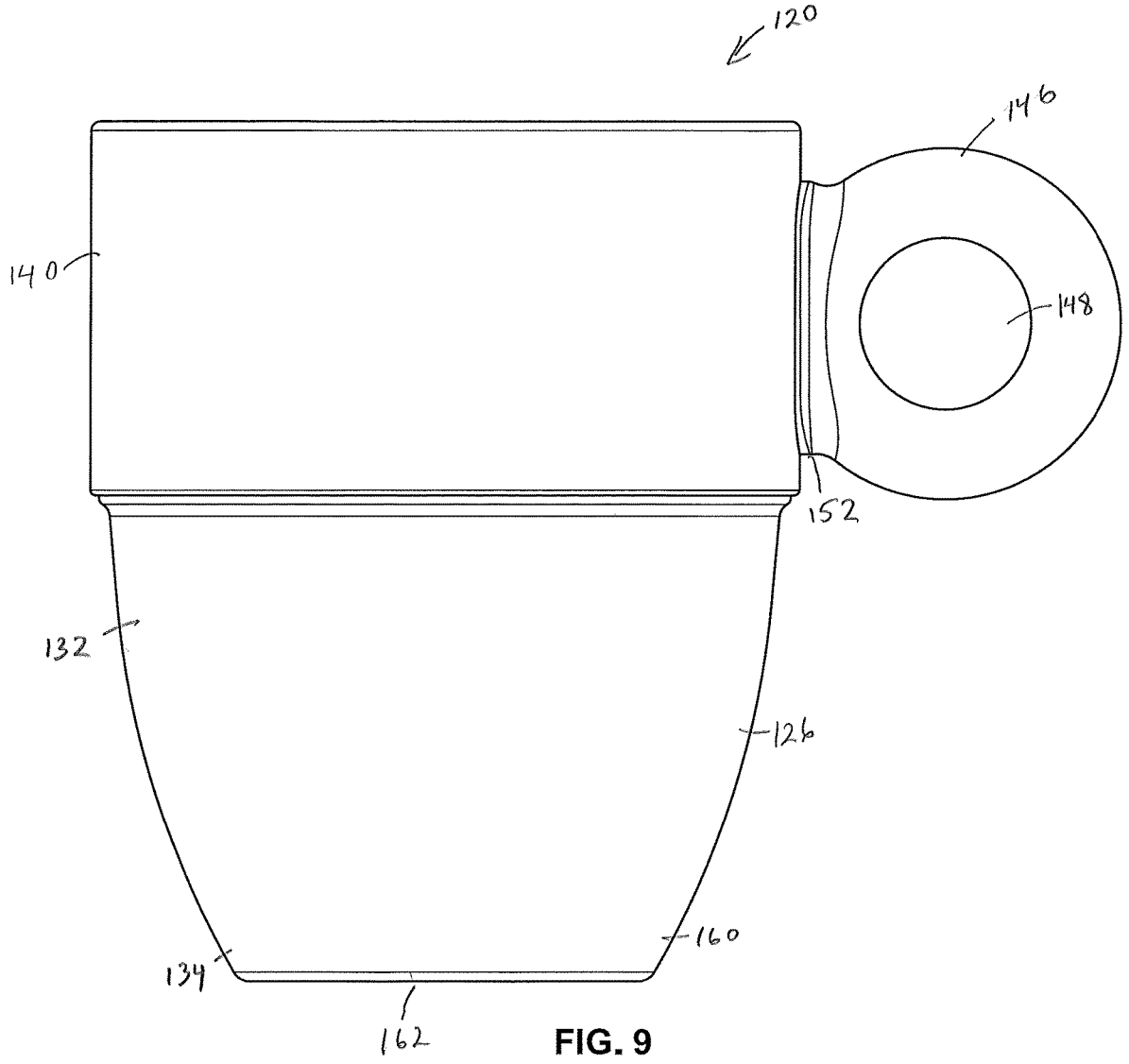
FIG. 9 is an elevation view of the mug in FIG. 8 in the fully expanded state.
Figure 10:
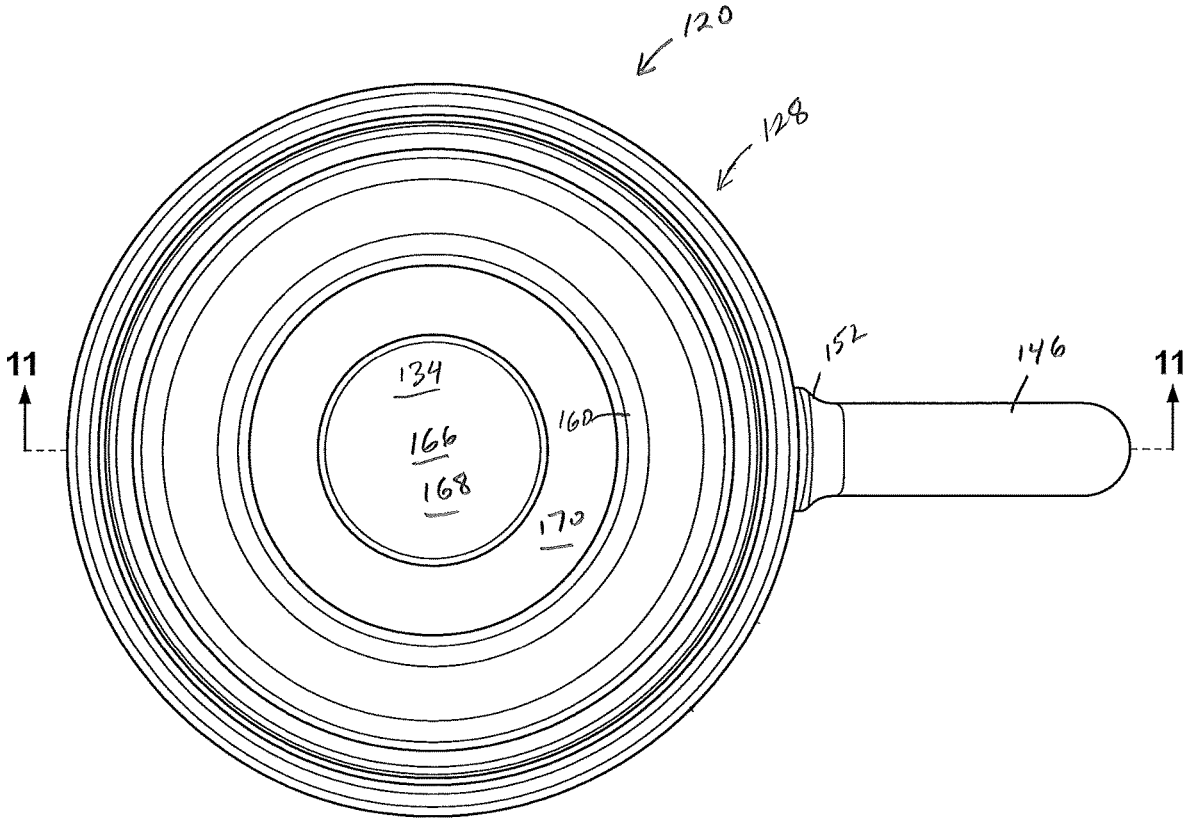
FIG. 10 is a plan view of the mug in FIG. 8 from above in the fully expanded state.
Figure 11:
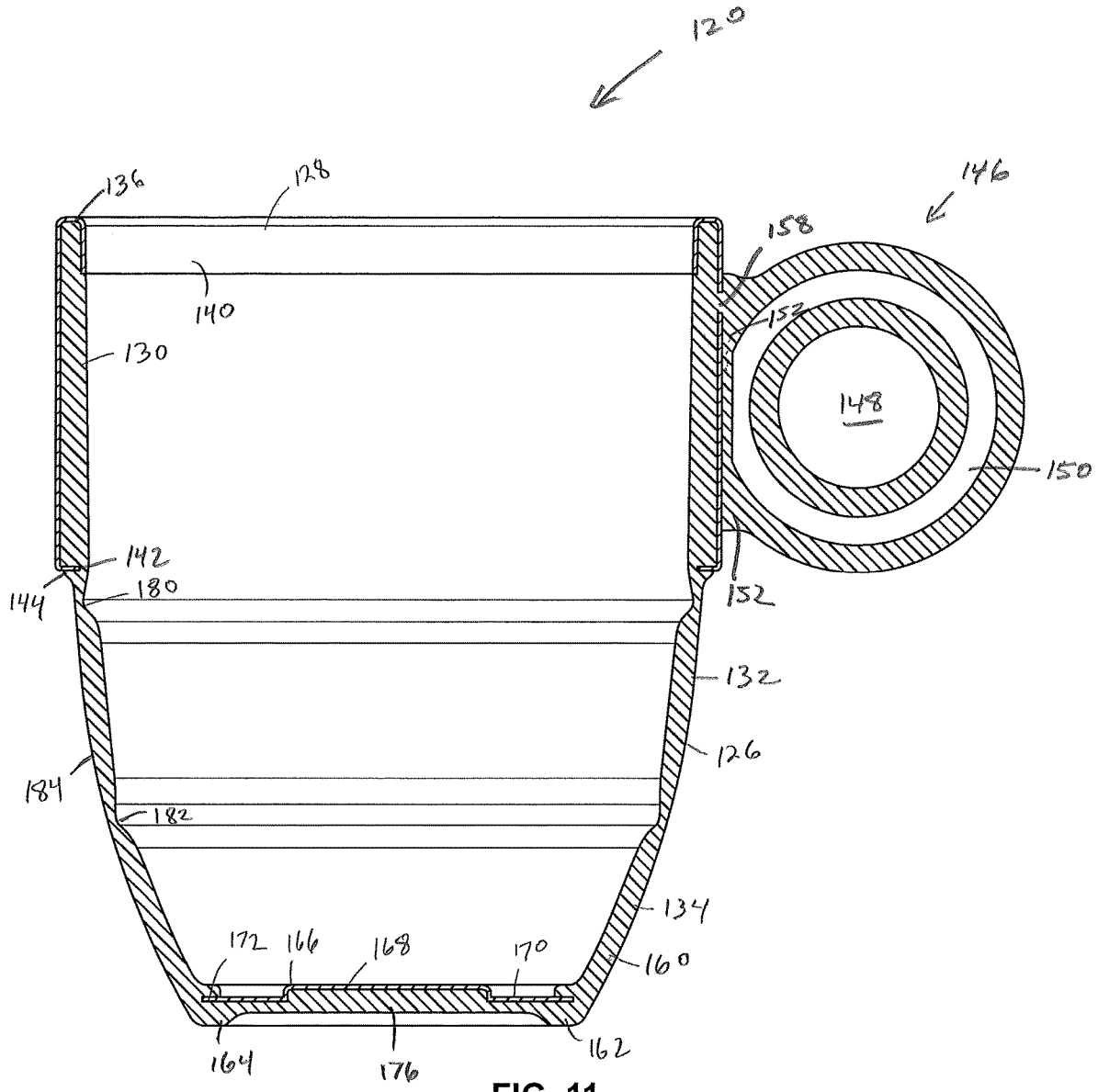
FIG. 11 is a cross-sectional elevation view of the mug of FIG. 8 in the fully expanded state along line 11-11 shown in FIG. 10.
Figure 12:
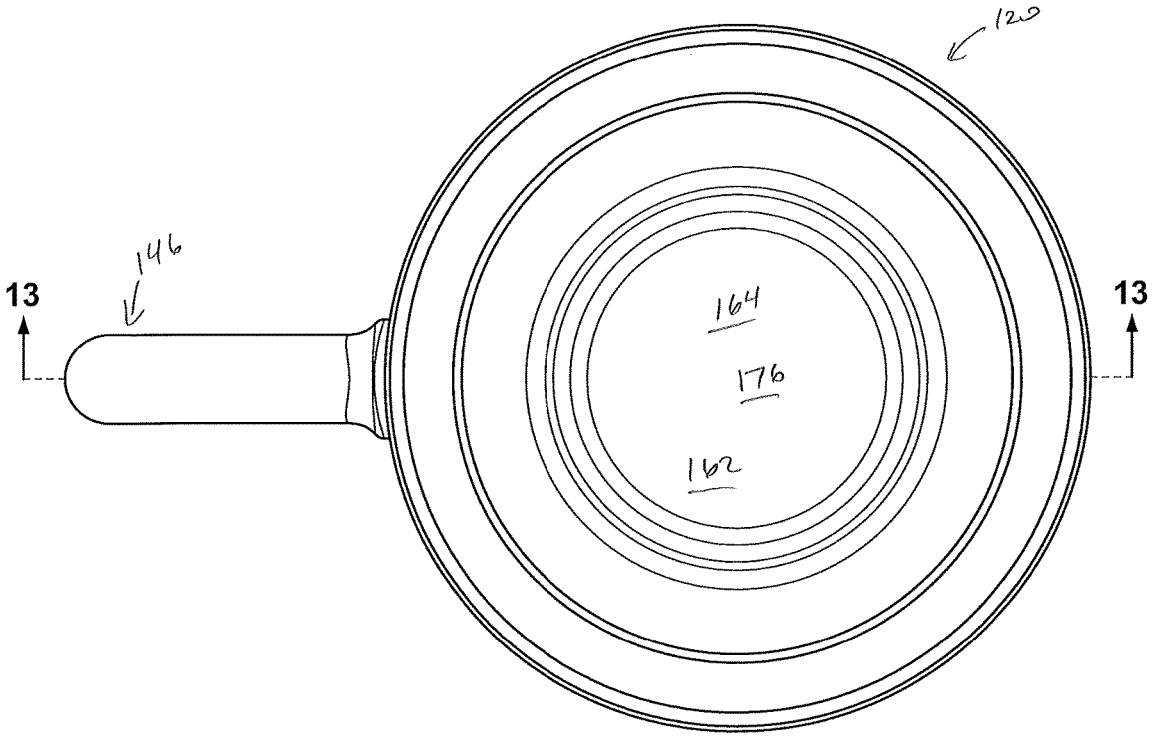
FIG. 12 is a plan view of the mug of FIG. 8 in the fully collapsed state.
Figure 13:
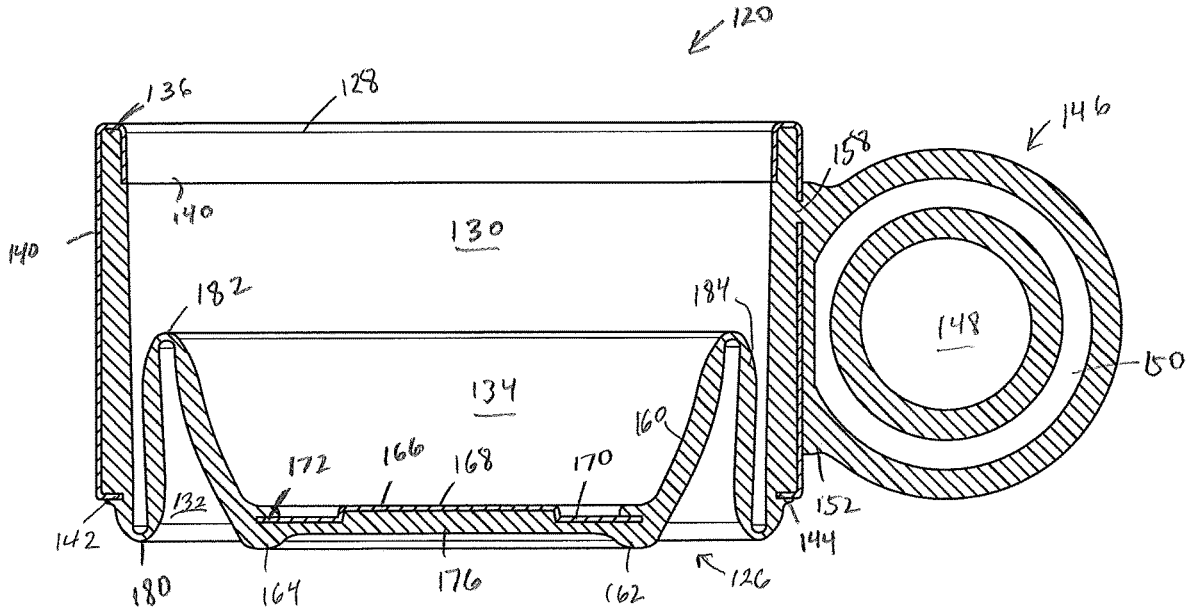
FIG. 13 is a cross-sectional elevation view of the mug of FIG. 8 in a fully collapsed state along line 13-13 shown in FIG. 12.

Lid 22 covers opening 28. Lid 22 has an aperture 74 for dispensing liquid, which may be closed or covered by a slide 76 having an upstanding tab 78. Slide 76 may move between open and closed positions by rotation (not shown) or translation. Slide 76 where shown is shown in the closed position in FIGS. 1-7. Slide 76 has prongs 79 which pass through slide apertures 80 in lid 22. Prongs 79 and slide apertures 80 serve to guide slide 76 and attach slide 76 to lid 22. Lid 22 has a circular sidewall 82 having one or more stiff or flexible protuberances 84 (in the form of lips) forming an annulus around sidewall 82 as best shown in FIGS. 4 and 6. When lid 22 is fully inserted into mug 20 as shown in FIGS. 4 and 6, at least one of protuberances 84 engage top tier 30 below the bottom 88 of metal cladding 40 on the inside of mug 20. Protuberances 84 seal the mug and secure lid 22 to mug 20. Advantageously, one of protuberances 84 contacts the underneath of bottom 88 to better secure lid 22. Protuberances 84 may be made from any suitable flexible material including silicone. Lid 22 also has a rim 90 that sits on top of rim 36 having a tab 92 for removing lid 22 from mug 20.

With reference to FIGS. 8-13, mug 120 according to another embodiment of the invention is described and illustrated. Mug 120 has a flexible body 126, which is preferably unitary and preferably watertight, and made from a flexible material. Body 126 has an opening 128. Body 126 preferably has three tiers, top tier 130, a middle tier 132 and a bottom tier 134. Top tier 130 is substantially cylindrical, but tier 134 is substantially frusto-conical and tier 132 can be substantially cylindrical or frusto-conical.

Mug 120 has a rim 136 and a metal cladding 140 which covers rim 136 and most of the outside of top tier 130. Metal cladding 140 also covers part of the inside of top tier 130. Metal cladding 140 has a hook 142 which is embedded into top tier 130 around a circumference 144 of top tier 130. Hook 142 can be completely bent back as in a fishing hook, but is sufficient that it angle into top tier 130 so that it is held by tier 130. Preferably the angle is approximately 90 degrees.

Attached to top tier 130 is a handle 146 having an opening 148 for one or more fingers to grip handle 146. In this invention, handle 146 is be considered to be attached to mug 120 and top tier 130 even if tier 130 and handle 146 are molded in the same molding operation. As can best be seen in FIGS. 11 and 13, handle 146 has an internal ring 150, which is rigid and provides rigidity to handle 146. Internal ring 150 has a ring shape that is flattened in the vicinity of cladding 140. Suitable rigid materials for internal ring 150 include metal, which can be the same as cladding 40 and 140. Around internal ring 150 is the same flexible material as body 126. Surprisingly, despite the material being flexible, the connection (as indicated by number 152) of handle 146 to tier 130 is substantially rigid because of inter alia the proximity of internal ring 150 to cladding 140 and the large area of connection 152, the area being perpendicular to the cross-sections shown in FIGS. 11 and 13. Alternatively metal cladding 140 and internal ring 150 can be joined directly to each other such as by a welding operation to provide rigidity to the connection of handle 146 to tier 130. Cladding 140 has an opening 158 so that a molten thermoplastic or uncured plastic or elastomer can flow through opening 158 during the molding of mug 120. Advantageously, opening 158 allows mug and handle to be easily molded together such that connection 152 is rigid. This rigidity is important because otherwise liquid in mug 120 could spill out if mug 120 sagged relative to handle 146.

Middle tier 132 is located between top tier 130 and bottom tier 134.

Bottom tier 134 has a sidewall portion 160 and a base portion 164 which is part of base 162 of mug 120. Mug 120 has a metal plate 166, which is a generally circular or disc shaped with a raised central portion 168 and an annular flange portion 170. Portion 170 has an outer annulus 172 that is embedded into bottom tier 134 proximate to where sidewall portion 160 meets base portion 164. Base portion 164 has a raised central portion 176 which follows the underside of plate 166 to better maintain plate 166 in place and is also raised such that it would not contact a flat surface on which mug 120 is placed. As shown none of plate 166 is visible from a perspective beneath base portion 164. Bottom tier 134 can vary from the above description in the same ways as bottom tier 34 discussed earlier.

Flexible body 126 has a plurality of living hinges, preferably two, including a first living hinge 180 and a second living hinge 182. First living hinge 180 is located between top tier 130 and middle tier 132. Second living hinge 182 is located between middle tier 132 and bottom tier 134. Preferably, first and second living hinges 180, 182 connect the tiers that they are located between. Living hinges 180 and 182 are shown as being folded in FIG. 13 which illustrates mug 120 in a fully collapsed state and unfolded in FIGS. 8-11 which illustrate mug 120 in a fully expanded state. It is also possible for one of living hinges 180 and 182 to be folded and the other to be unfolded in a partially collapsed state. Mug 120 has a flexible sidewall 184 below the top tier. Advantageously, flexible sidewall 184 has a smooth appearance similar to a ceramic tea cup for aesthetic reasons. This smooth appearance is achieved by making the exterior of living hinges 180 and 182 follow the smooth contour of middle tier 132 and sidewall portion 160 of bottom tier 134. In part this is achieved by making living hinges thinner by removing material from the inside of body 126.

Mug 120 is shown without a lid. However, it could have a lid similar to lid 22.

Benefits of the collapsible mugs of the invention include easier manufacture. The unitary construction of the flexible body which if watertight, e.g., without holes in the base, means the collapsible mug is also watertight without risk of failure at joints causing leaking. The three tier construction of the collapsible mug allows the mug to have a wider base than a five tier construction. The use of a metal or rigid plate improves the collapsibility of the collapsible mug as the rigid base does not deform during an attempted collapse and improves the stability of the mug. The collapsible mugs also have an esthetically pleasing appearance particularly if the cladding is metal and if the sidewalls of the bottom and middle tiers are smooth. The cladding of the top tier make the mug easy to hold as does the handle.

Mugs of the invention may be made by overmolding onto a metal cladding preform, a metal plate and optionally a ring or handle preform preferably in a single overmolding operation to produce a unitary and watertight flexible body which is integrated with a metal cladding, the metal plate and a handle including the ring. Before the overmolding operation, the metal cladding preform, the metal plate and optionally the ring would be loaded in a mold for the mug. During the overmolding, a flexible material is injected into the mold and flows into contact with the metal cladding preform. When making a mug with a handle, the metal cladding preform has an opening such as opening 148 to permit the overmolding material to flow through the opening so that the overmolding material flows between the body portion of the mold and the handle portion of the mold. Any lids would generally be made separately.

Of course, in the context of containers according to the present invention, as in common parlance, it will be understood that "stiff," "rigid," and "flexible" are relative terms. Thus unless further specified, referring to a tier as "stiff" herein simply means, at a minimum, that the tier is stiff enough to impart a force to its neighboring flexible tier or tiers sufficient to fold the flexible tier or tiers between relatively folded and unfolded stable positions (optionally causing the flexible tiers to "snap" between positions), without itself folding (i.e., without inverting its vertical orientation, with respect to the top and bottom of the container). On the other hand, a tier that is considered "rigid" for purposes of the invention typically will not even appreciably yield or deform, let alone fold, in the direction of the force imparted to fold the flexible tiers, in response to either that force or other typical loads associated with normal use of the container. Still further, a rigid tier preferably will not appreciably deform in any direction during normal use of the container. A "rigid" tier that exhibits the latter characteristic of not appreciably deforming in any direction is typically formed of a different material than the flexible tiers, rather than the same material in a different size or geometric configuration. Finally, all "rigid" structures and materials are also to be considered stiff, and structures or materials referred to as "stiff" may or may not be rigid, unless expressly stated as not being rigid but only stiff.

Although each flexible tier of the various containers described herein is illustrated as having only two stable positions, it is also within the scope of the invention to provide one or more flexible tiers having a plurality of stable partially expanded positions, for example by providing one or more flexible tiers having a stepped profile comprising a series of accordion-like pleats of flexible material, the pleats comprising peripheral bands of material oriented in alternating directions and connected to adjacent bands by living hinges, so that each pleat can be independently folded and unfolded (not shown), being stable in either state. Also, a wall structure of a container according to the invention need not have the exact shapes of the containers shown in the Figures, but may have any suitable shape, such as round, oval, rectangular with rounded corners, or other shape as desired. For example, successive accordion pleats may be stable in relatively "bent" orientations, in which part of the circumferential length of a pleat is folded and the remainder of the length is unfolded.

The flexible body of the containers of the invention may be made from any suitable flexible material including food grade silicone and thermoplastic elastomers. The metals used in the containers of the invention include stainless steel, aluminum, and iron. To prevent corrosion, the metal may have any suitable coating. Stainless steel is preferably not coated and can have any suitable finish including brushed or polished. Suitable rigid materials that could be used instead of metal include nylon and polypropylene.

In the context of containers according to the present invention, the living hinge is thinner than the surrounding material, e.g., adjacent tiers, and may be repeatedly folded and unfolded over 100 times without damaging the hinge.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A collapsible container of a flexible material comprising:

a flexible body including (1) a plurality of tiers including a top tier, a middle tier and a bottom tier, the bottom tier having a closed bottom and (2) a plurality of living hinges including a first living hinge between the top tier and the middle tier and a second living hinge between the middle tier and the bottom tier; and a rigid plate at least partially embedded in the closed bottom that makes an otherwise flexible closed bottom rigid.

2. The container of claim 1 having a collapsed state in which the bottom tier is at least partially located within the top tier and the container in the collapsed state being expandable to an expanded state by gripping the exterior of the bottom tier and pulling the bottom tier away from the top tier.

3. The container of claim 2 further comprising a rigid cladding providing rigidity to the top tier so that the container may be easily gripped around the top tier.

4. The container of claim 1 further comprising a rigid cladding providing rigidity to the top tier so that the container may be easily gripped around the top tier.

5. The container of claim 4 wherein the top tier has an elastomeric grip around the rigid cladding.

6. The container of claim 4 wherein the top tier has a handle having an opening for one of more fingers.

7. The container of claim 6 wherein the handle comprises an internal rigid ring and an elastomeric material covering the internal rigid ring and joining the handle to the flexible body, the handle being rigid and rigidly joined to the flexible body.

8. The container of claim 4 further comprising a top opening and a removable lid having a selectively closable opening, the lid having a circumferential sealing protuberance, the protuberance in contact with the top tier when the lid is fully inserted into the top opening.

9. The container of claim 8 further comprising a rim around the top opening, the rigid cladding covering the rim, the rigid cladding having an underside inside the container, the protuberance in contact with the underside of the rigid cladding.

10. The container of claim 1 wherein in an expanded state the top tier is adjacent the middle tier and the bottom tier is adjacent the middle tier.

11. The container of claim 10 wherein the middle tier is more flexible than the top and bottom tiers.

12. The container of claim 1 wherein the container has a sidewall extending below the top tier, the sidewall having a smooth appearance.

13. The container of claim 1 wherein the rigid plate improves the collapsibility of the container.

14. The container of claim 1 wherein the rigid plate has an outer portion embedded into the bottom tier and a central portion having a recess that is either above or below the outer portion, the flexible body filling the recess to maintain the rigid plate at least partially embedded in the bottom tier.

15. The container of claim 14 wherein the rigid plate is visible from below the container or through an opening in the top tier.

16. The container of claim 1 wherein the flexible body is unitary and watertight.

17. The container of claim 14 wherein the rigid plate is composed of metal.

* * * * *